US006323747B1

(12) United States Patent
Mader et al.

(10) Patent No.: US 6,323,747 B1
(45) Date of Patent: Nov. 27, 2001

(54) RELAY WITH CONTACT SPRINGS

(75) Inventors: Leopold Mader, Mödling; Rudolf Mikl, Arbesthal, both of (AT)

(73) Assignee: Tyco Electronics Austria GmbH, Vienna (AT)

( * ) Notice: Subject to any disclaimer, the term of this patent is extended or adjusted under 35 U.S.C. 154(b) by 0 days.

(21) Appl. No.: 09/423,133

(22) PCT Filed: Apr. 24, 1998

(86) PCT No.: PCT/EP98/02439

§ 371 Date: Nov. 5, 1999

§ 102(e) Date: Nov. 5, 1999

(87) PCT Pub. No.: WO98/50933

PCT Pub. Date: Nov. 12, 1998

(30) Foreign Application Priority Data

May 5, 1997 (DE) ..... 197 18 985
Feb. 5, 1998 (DE) ..... 198 04 572

(51) Int. Cl.[7] ..... H01H 51/22
(52) U.S. Cl. ..... 335/80; 335/78
(58) Field of Search ..... 335/78–86, 128, 335/124, 130–133

(56) References Cited

U.S. PATENT DOCUMENTS 5,392,015 * 2/1995 Matsuoka et al. ..... 335/78
5,790,004 * 8/1998 Matsuoka et al. ..... 335/78
5,894,254 * 4/1999 Reiter et al. ..... 335/80
5,896,075 * 4/1999 Kern ..... 335/78
5,905,422 * 5/1999 Doneghue ..... 335/78
5,936,496 * 8/1999 Kern ..... 335/80

FOREIGN PATENT DOCUMENTS 301930 12/1954 (CH) .
2 039 939 12/1973 (DE) .
32 02 579 8/1983 (DE) .
36 44 172 7/1988 (DE) .
43 16 285 12/1993 (DE) .
43 26 685 2/1994 (DE) .
0 784 330 1/1997 (EP) .
2.180.914 11/1973 (FR) .

* cited by examiner

*Primary Examiner*—Lincoln Donovan
*Assistant Examiner*—Tuyen T. Nguyen
(74) *Attorney, Agent, or Firm*—Schiff Hardin & Waite

(57) ABSTRACT

The relay has a base body, an electromagnet system having a coil, core and armature, as well as a contact arrangement having at least one stationary contact spring and at least one moving contact spring. The contact springs are each designed as planar sheet-metal parts and are anchored in the base body approximately in the same plane, without any permanent bending. In order to make contact, they are provided with an overlap by means of L-shaped end sections; in addition, prestressing of the stationary contact springs is produced by in each case one stop on the base body.

16 Claims, 6 Drawing Sheets

RELAY WITH CONTACT SPRINGS

BACKGROUND OF THE INVENTION

The invention relates to a relay having a base body, an electromagnet system which is connected to the base body and has a coil, a core and an armature, and a contact arrangement having at least one stationary contact spring and at least one moving contact spring which are anchored at least approximately in a common plane alongside one another in the base body and whose contact-making regions overlap one another by virtue of the L-shaped design of at least one contact spring, in which case it is possible for the armature to operate the moving contact spring via a slide which can move approximately at right angles to the longitudinal extent of said moving contact spring.

DE-AS 20 39 939 discloses a contact unit for such a relay. There, contact springs and mating contact supports are in each case anchored in a common plane in a dielectric body, lateral overlapping of the contact-making ends being achieved by means of bending. This involves a series of accurate bending processes during the production of the contact elements, the process of mounting in the dielectric body, which preferably involves embedding there, also being dependent on complex guidance and alignment.

DE 26 27 168 discloses a moving contact spring being split into two limbs, one limb being designed as a contact limb and the other as a restoring limb. Although use of this measure in a relay of the type mentioned above is possible, it would, however, involve a more complex design of the individual parts.

SUMMARY OF THE INVENTION

The aim of the present invention is to provide a relay of the type mentioned initially, which is equipped with contact springs of as simple a form as possible, in which case these contact springs are intended to be capable of being produced and assembled as easily as possible, in order that the relay, overall, can be produced in a particularly cost-effective manner.

According to the invention, this aim is achieved in that all the contact springs are designed as planar leaf springs without any permanent bending, and in that the stationary contact spring, resting on a stop on the base body, is prestressed by elastic deflection from its clamping-in plane.

Thus, in the case of the relay according to the invention, the contact arrangement (which, in the simplest case, is designed as a break contact or as a make contact) has only contact springs which are stamped from a planar metal sheet, are not prebent in any way and overlap one another by virtue of the L-shaped design of at least one spring end. Prestressing of the stationary contact spring in the rest state and a contact gap (if this is a make contact) are produced by a stop on the base body, on which stop the relevant contact spring rests only by virtue of insertion into the base body, and experiences corresponding deflection. For its part, the moving contact spring normally rests on the slide, by means of which (in the rest state and depending on the type of contact) it can likewise be deflected at this stage to a greater or lesser extent from its plane. In any case, the contact springs can be produced very cost-effectively and easily, since the respective spring characteristic is not achieved by permanent bends on the contact springs but by the geometry of the base body with the stop, at least for the stationary contact spring. If there are a number of contact springs, a number of different stops can also, of course, be provided in order to achieve correspondingly different prestresses.

A particularly simple design of the relay is obtained if a coil former having two coil flanges is used as the base body, the contact springs being anchored approximately parallel to the coil axis in a first coil flange, and the stop which produces the prestressing being provided on the second coil flange. Production becomes particularly cost-effective especially if the stationary contact spring and the moving contact spring are of identical design, being inserted into the base body in the common plane, with mirror-image symmetry with respect to one another.

In a preferred refinement of the relay according to the invention the magnet has a T-shaped system whose longitudinal limb extends axially through the coil former, a U-shaped armature being arranged on that side of the coil former which faces away from the contact springs, and the transverse web of the U-shaped armature being mounted in the region of the first coil flange on the free end of the core longitudinal limb, and the free ends of the longitudinal arms of the armature operating the slide.

A particularly simple design of the relay, with few parts, is also obtained if the moving contact spring exerts a restoring force on the armature, via the slide. In this case, a preferred refinement furthermore provides that via a fulcrum in the central region of its longitudinal limbs, the armature is forced by the restoring force of the contact spring into its mounting on the core end. This fulcrum can be produced without any additional parts by the armature having lateral shoulders which are integrally formed on both sides and rest on an inner edge of the housing cap.

An advantageous further refinement provides that, on a stationary contact spring, an integrally formed restoring spring arm, which is decoupled from the contact spring itself, acts on the slide and, via this slide, prestresses the armature into its rest position.

Owing to the fact that the restoring spring arm is integrally formed on a stationary contact spring which is any case supported on the base body, the dimensions and spring characteristics of the moving contact spring can be designed just to produce the respective contact pressure. This also allows a break contact or a changeover contact to be produced in a simple manner. In this case, no further individual parts are required apart from the additional break spring; the moving contact spring and the make contact spring can be used as in the case of the make-contact relay, without any design change. The restoring spring arm is preferably integrally formed on the stationary break contact spring, as a result of which no interference occurs with the moving contact spring, and this provides the solution with the simplest design.

The invention will be explained in more detail in the following text using exemplary embodiments and with reference to the drawings.

DESCRIPTION OF THE PREFERRED EMBODIMENTS

Figure 1:
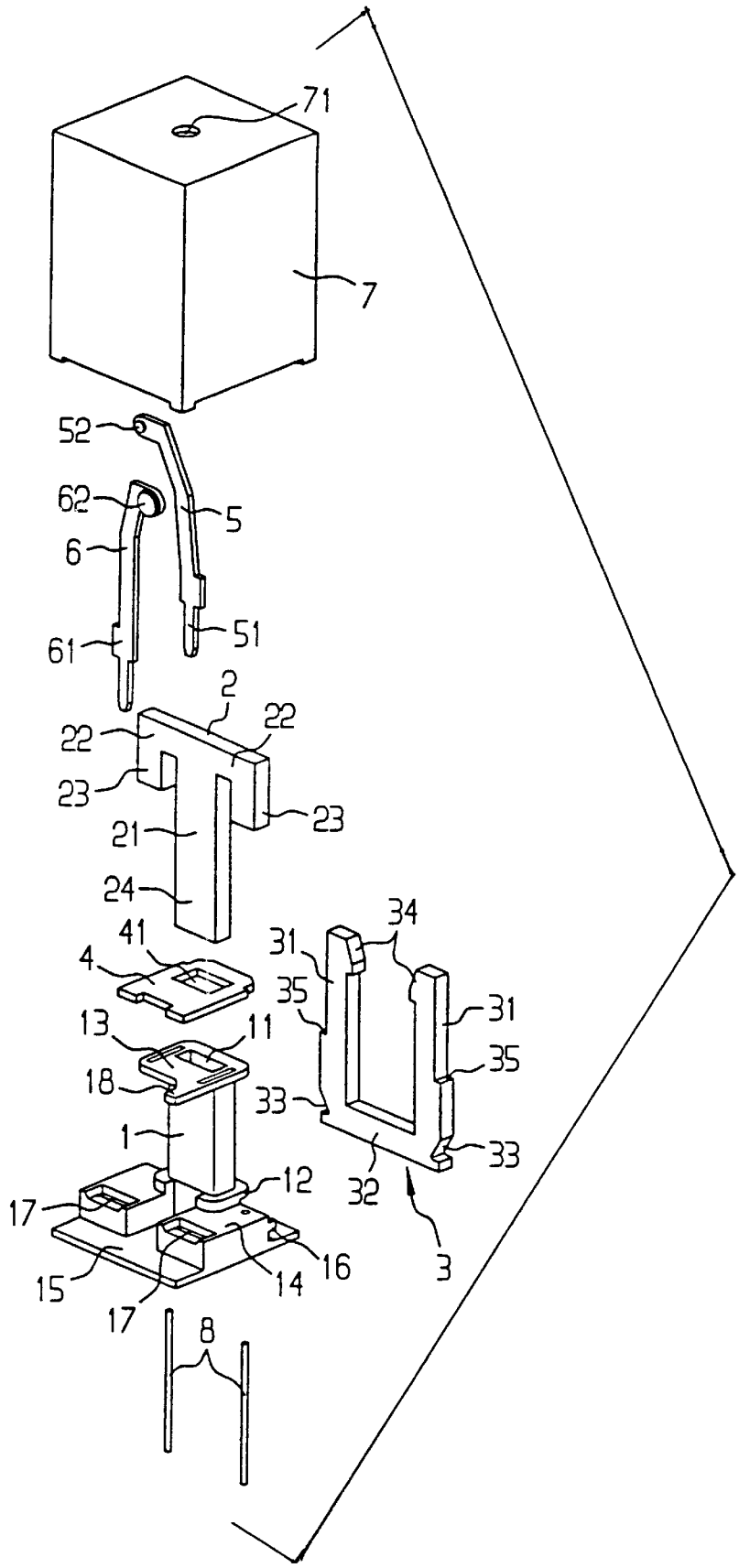
FIG. 1 shows an exploded illustration of a make-contact relay designed according to the invention.

The relay illustrated in the drawing comprises a coil former 1, a core 2 which is T-shaped or approximately M-shaped, a U-shaped armature 3, a slide 4 in the form of a card, a stationary contact spring 5, a moving contact spring 6, a cap 7 as well as two coil connecting pins 8 which are anchored in the coil former.

The coil former 1 has an axial through-opening 11 as well as a first flange 12 and a second flange 13, between which a winding 10 is fitted. At the end, an attachment 14 for armature mounting is integrally formed on the coil flange 12, and merges into a base plate 15. Limiting or safety pins 16 for the armature are also integrally formed on the attachment 14, and plug-in slots 17 are additionally formed in this attachment, through which connecting elements 51 and 61, respectively, of the contact springs 5 and 6 can be passed through the base plate 15 vertically outwards. Furthermore, a stop tab 18 for the stationary contact spring 5 is integrally formed on the second coil flange 13.

The T-shaped core 2 has a longitudinal limb 21 which is inserted into the through-opening 11 in the coil former, as well as two transverse limbs 22, to each of whose ends side arms 23 are fitted, parallel to the longitudinal limb 21. The U-shaped armature 3 comprises two longitudinal arms 31 and one transverse web 32, the latter of which is mounted on the free end section 24 of the core 2 and is then located in a recess between the first coil flange 12 and the base plate 15. The armature is protected against lateral movements by the two safety pins 16 on the base attachment 14, which engage in corresponding recesses 33 in the armature, without this impeding its switching movement. The free ends of the longitudinal arms 31 are broadened to form hook-shaped pole ends 34, which engage around the second coil flange 13, and form two parallel air gaps, when the relay is open, with the transverse limbs 22 and their side arms 23 of the core.

The stationary contact spring 5 and the moving contact spring 6 are anchored by their connecting elements 51 and 61, respectively, in the plug-in slots 17 in the base attachment 14, and these connecting elements 51 and 61 are integrally formed or are attached in a known manner. In the present example, the two contact springs 5 and 6 are of identical design, and are provided with contacts 52 and 62, respectively.

Figure 2:
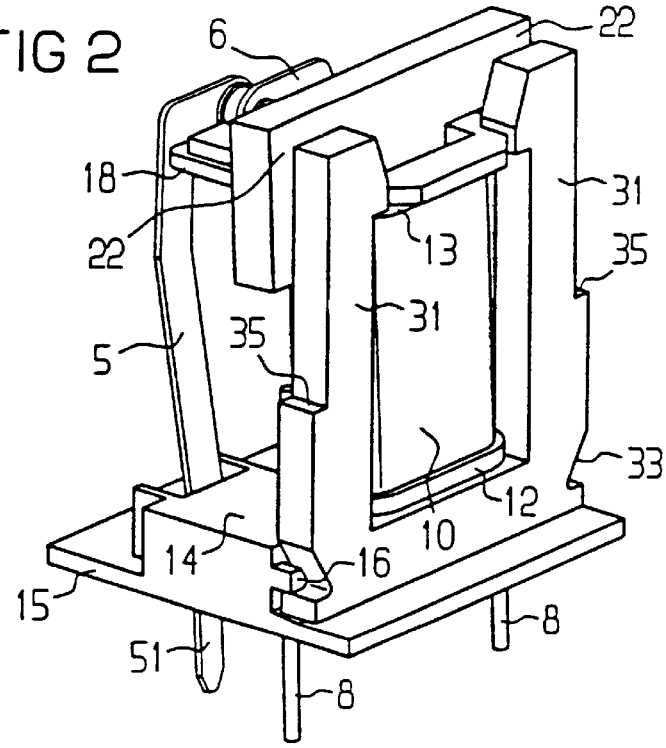
FIGS. 2 and 3 show two perspective views of a completely assembled relay according to FIG. 1—without a cap.
Figure 3:
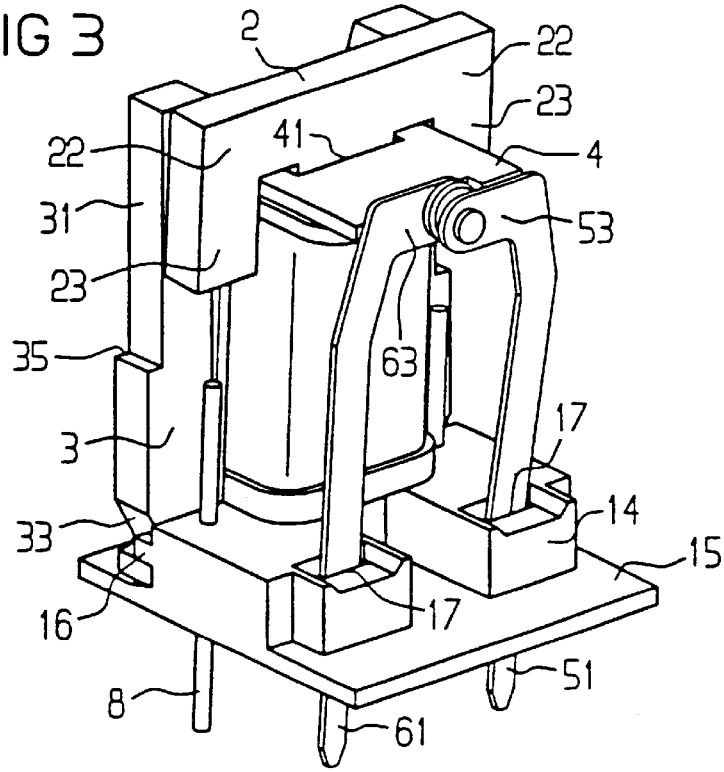

The mutual overlap in order to make contact is produced by an L-shaped end portions 53 and 63 (see FIGS. 2 and 3) at their moving, contact-making ends.

The contact springs 5 and 6 are just cut out of flat sheet metal without any bend, and are inserted into the coil former. The mutual offset between their contact-making ends is obtained simply from the geometry of the coil former and of the slide 4. This slide is located between the coil flange 13 and the transverse limbs 22 of the core. It has a recess or opening 41 through which the core longitudinal limb 21 is passed. Once the parts have been joined together, the end section 53 (which has an L-shape) of the stationary contact springs 5 rests on the stop tab 18 of the coil former 1, and is thus given its prestressing in the rest position. On the other side of the contact, the end section 63 (which an L-shape) of the moving contact spring 6 rests on the slide 4. When the slide 4 is operated by the armature, the end section 63 is moved in the direction of the end section 53 of the stationary contact spring 5, and lifts the latter off its stop on the tab 18. This is how the contact force is produced.

Figure 4:
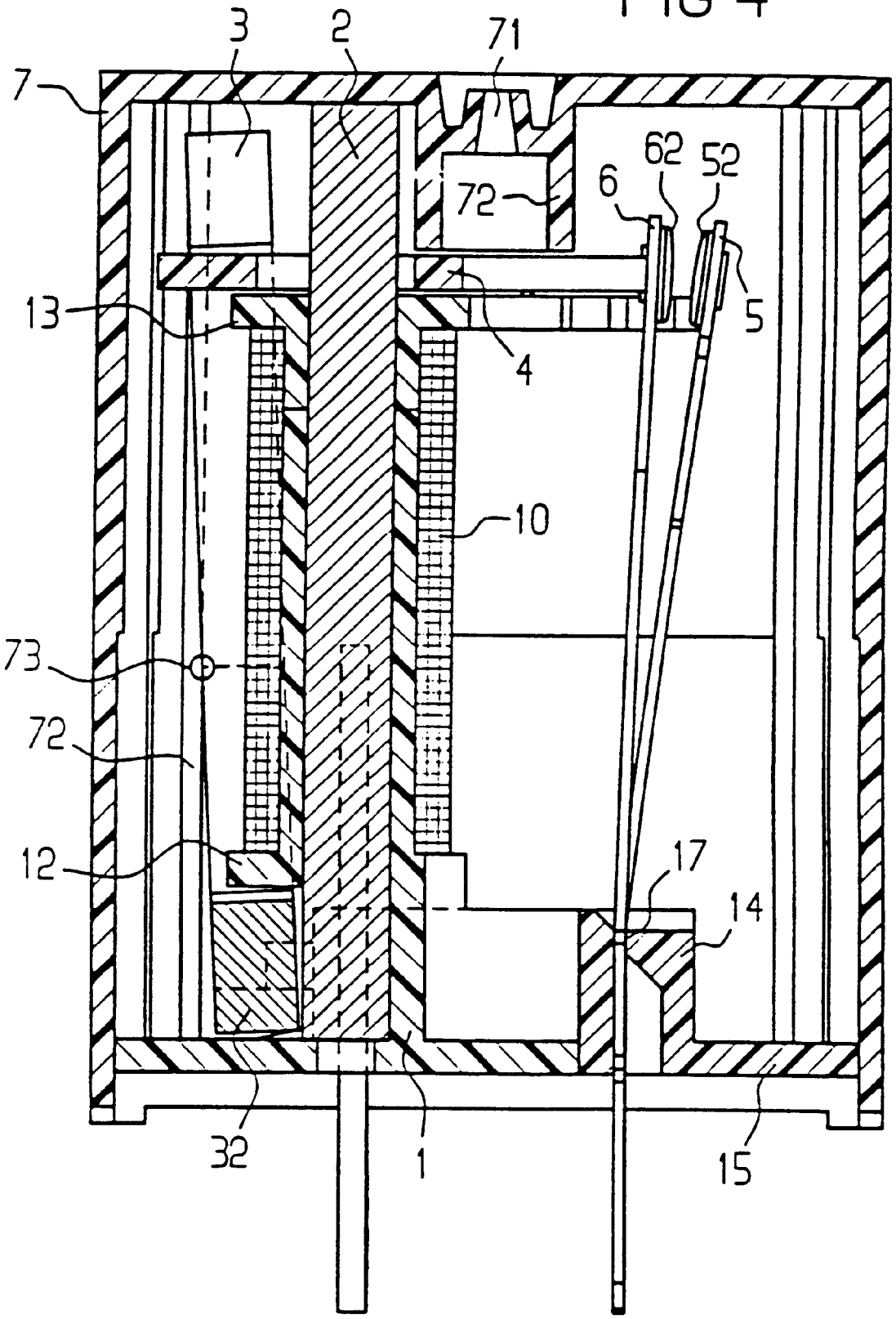
FIG. 4 shows a section through the coil axis of the completely assembled relay from FIG. 1.

After assembly of the individual parts described, the cap 7 is fitted over the relay. This cap 7 forms a closed housing with the base plate 15. As can be seen from FIG. 4, in the region of its top, the cap 7 has a ventilation hole 71, which opens into an attachment 72 which projects inwards. The latter attachment forms an additional guide for the slide 4. As can also be seen from FIG. 4, the armature 3 is prestressed, via the slide 4, in its rest position by the restoring force of the make-contact spring 6. In the process, lateral shoulders 35 of the armature strike against ribs 72 on the cap, by which means a fulcrum 73 is formed for the armature. Via this fulcrum 73, the lever effect causes the mounted end and the transverse web 32 of the armature to be forced into the mounting and against the end section 24 of the core. This results in reproducible flux transfer relationships in the armature mounting, and correspondingly low pull-in excitation.

Figure 5:
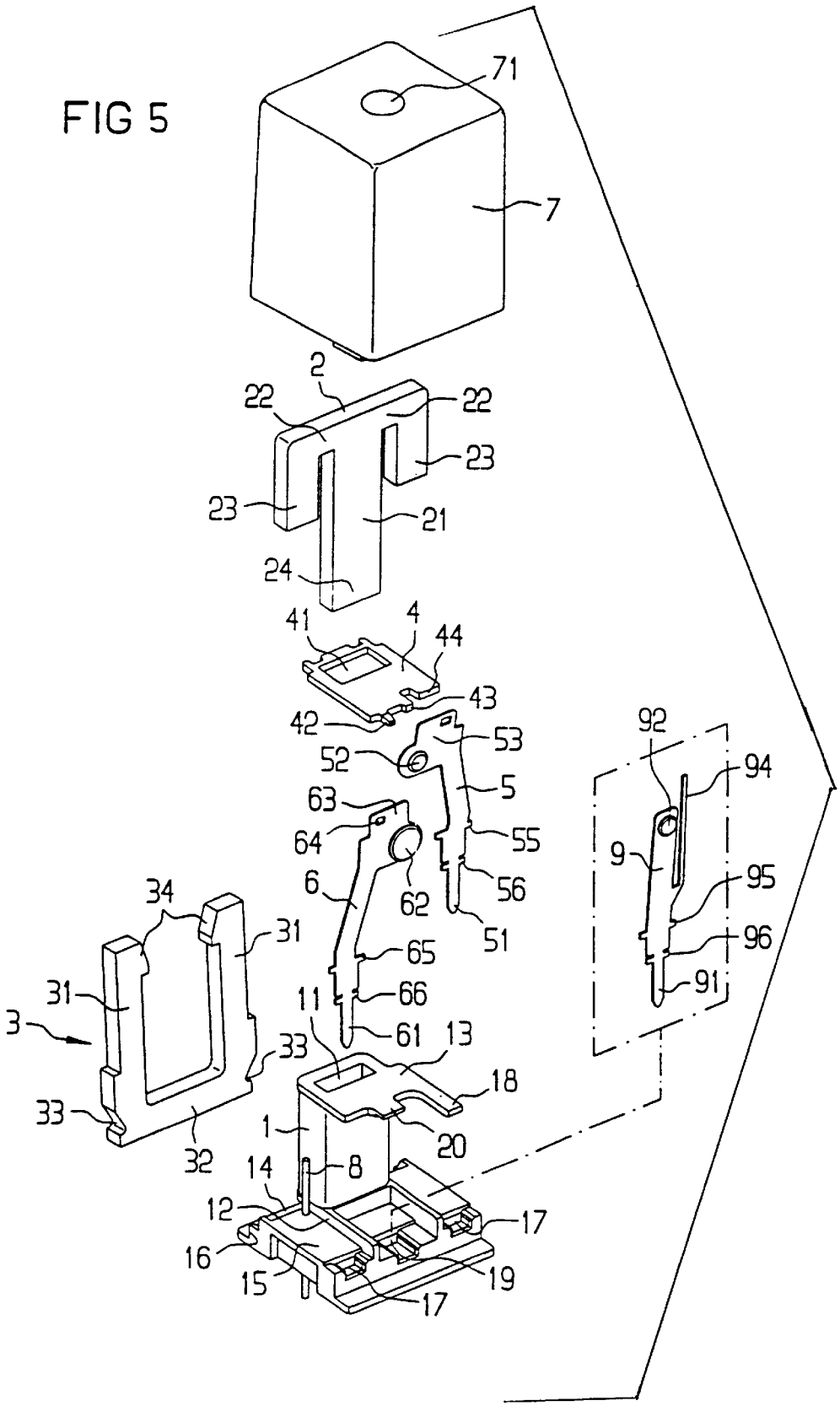
FIG. 5 shows an exploded illustration of a changeover-contact relay designed according to the invention.
Figure 6:
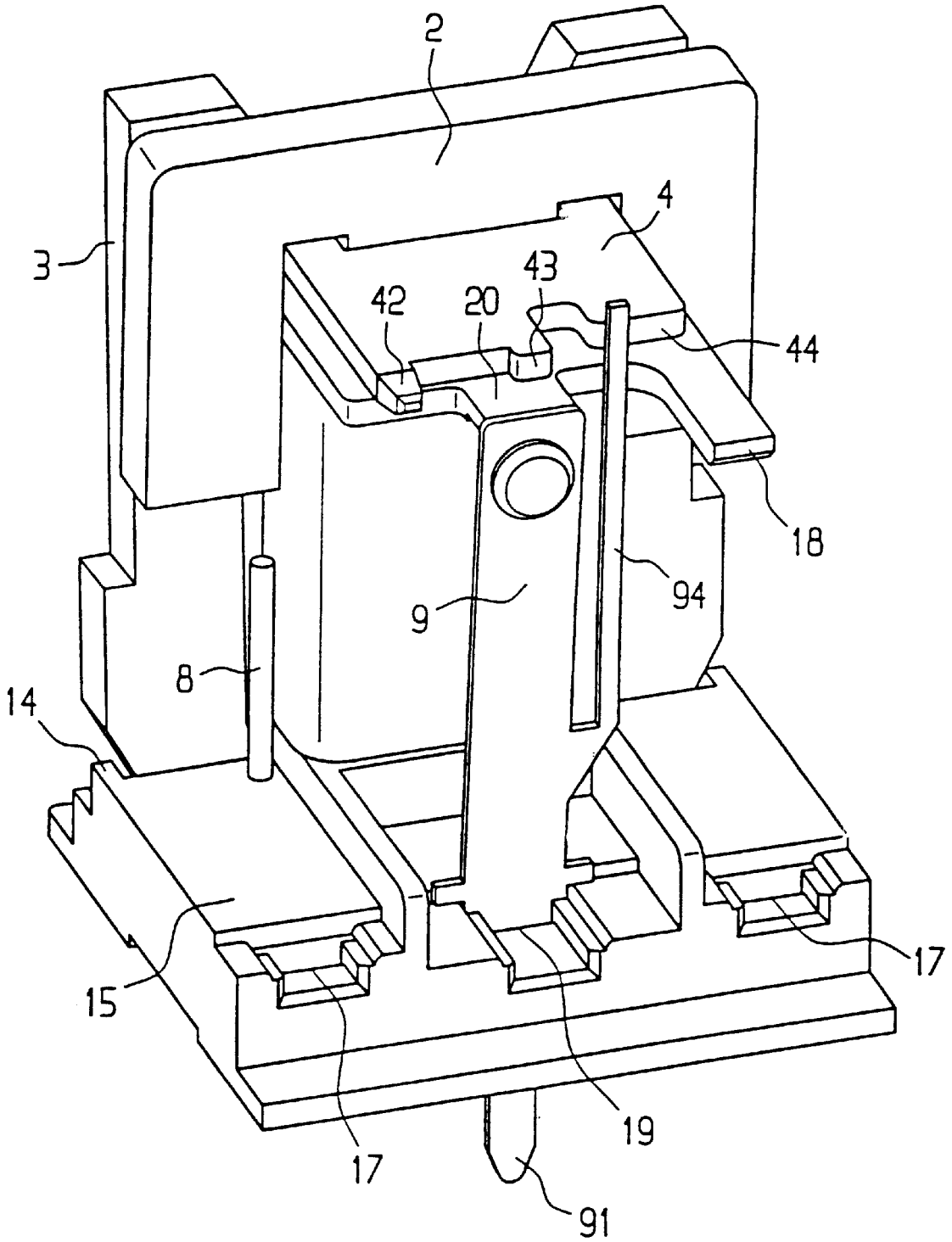
FIG. 6 shows the relay from FIG. 5 in the half-assembled state, but without a moving contact spring and without a make-contact spring.
Figure 7:
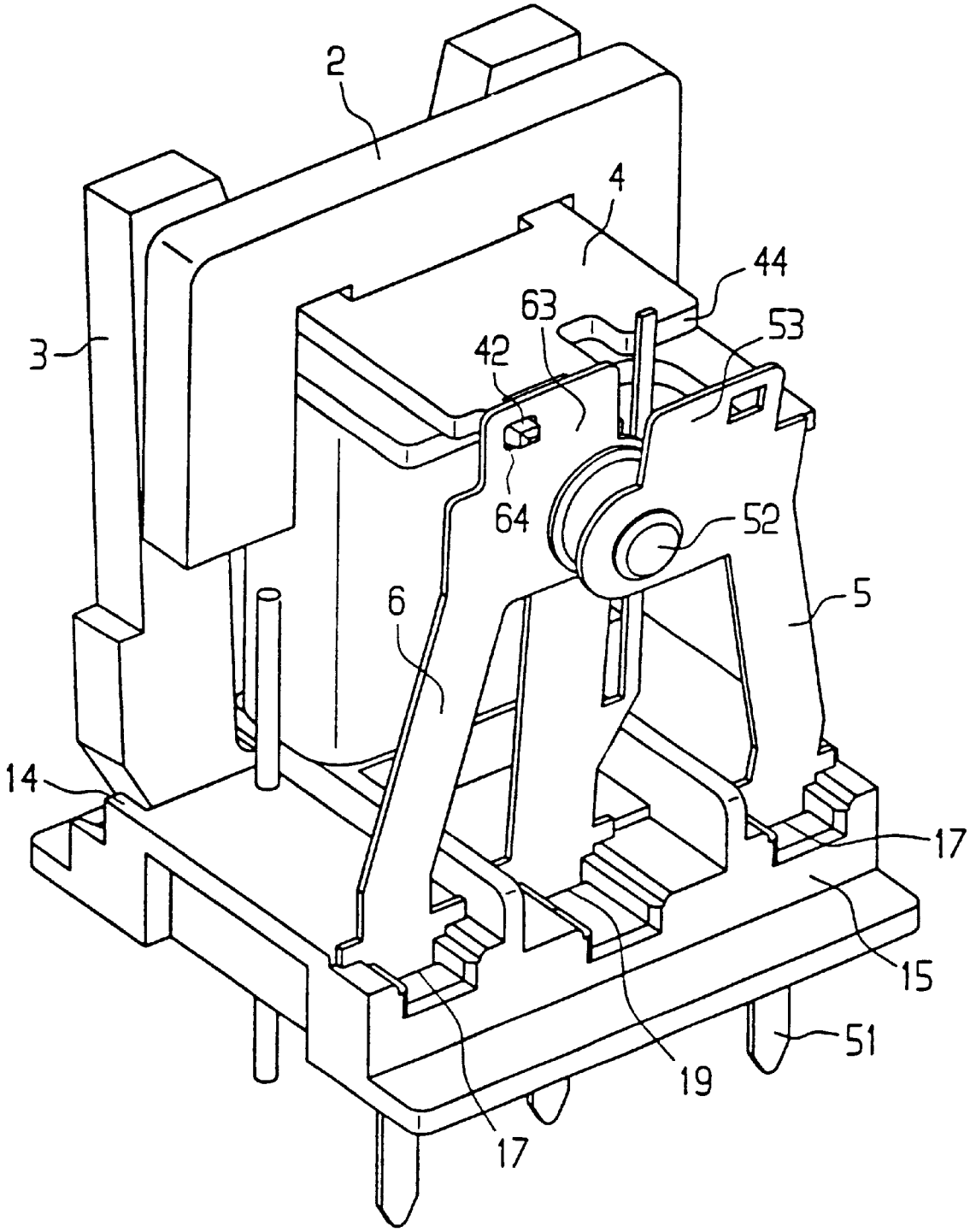
FIG. 7 shows a perspective view of a completely assembled relay—without a cap.

The changeover relay illustrated in FIGS. 5 to 7 comprises a coil former 1, a T-shaped, or approximately T-shaped, core 2, a U-shaped armature, a slide 4 in the form of a card, a stationary make-contact spring 5, a moving contact spring 6, a stationary break-contact spring 9, a cap 7 as well as two coil connecting pins 8 which are anchored in the coil former. While the individual parts are of identical or similar design to those in the preceding example of the make-contact relay, they have the same reference symbols and are not described in any further detail specifically.

The break-contact spring 9 is mounted in a plug-in slot 19 in the base plate 15. While the sheet-metal planes of the two contact springs 5 and 6 are mounted in a common plane in the plug-in slots 17, the sheet-metal plane of the contact spring 9 is arranged to be slightly offset with respect to the former in the plug-in slot 19, but parallel to it. All the contact springs are provided with stop lugs 55 as well as 65 and 95, respectively, which are integrally formed at the sides and by means of which they rest on the top of the respective plug-in slots 17 and 19, while bending lugs 56 and 66 as well as 96, respectively, on the underneath in each case can be deformed for protection.

In this case as well, the contact springs 5 and 6 are simply cut from a flat metal sheet without any bending, and are inserted into the coil former. The stationary break-contact spring 9 is likewise cut out of a flat metal sheet and is inserted into the coil former, namely into the plug-in slot 19. This spring 9 has a contact 92, which is opposite the moving contact 62. In addition, a restoring spring arm 94 is integrally formed in the same plane on the break-contact spring 9 and is decoupled from the actual break-contact spring, beyond whose free end it projects and acts as a restoring spring.

Once the parts have been joined together, the end section 53 (which has an L-shape) of the stationary make-contact spring 5 rests on the stop tab 18 on the coil former 1 and is thus given its rest prestressing. On the other side of the contact, the end section 63 (which has an L-shape) of the moving contact spring 6 rests on an operating tab 43 on the slide 4. The slide is also guided via a guide tab 42 in an aperture 64 in the contact spring 6. Furthermore, the slide has an additional stop tab 44, on which the restoring spring arm 94 rests and, via the slide, prestresses the armature into its rest position.

In the rest state, the slide and (through it) the armature are thus held by the spring arm 94 in their rest position, while the contact 62 makes a closed circuit with the contact 92. When the slide 4 is operated by the armature, the end section 63 of the moving contact spring 6 is moved in the direction of the end section 63 of the make-contact spring; at the same time, the contact 62 is lifted off the contact 92, and is made to touch the contact 52. At the same time, the end section 53 is also lifted off the stop on the tab 18, so that the contact force of the make contact is built up. Once the excitation is switched off, the slide is moved by the restoring force of the spring arm 94 into the original position, as a result of which the make contact is opened, and the break contact is closed.

What is claimed is:

1. A relay comprising:

a base body;

an electromagnetic system which is connected to the base body, said electromagnetic system having a coil with a central axis, a core on said central axis and an armature; and a contact arrangement having a stationary contact spring and a moving contact spring, each contact spring being a planar leaf spring with a connecting element and a contact-making region, the contact-making region of at least one contact spring having an L-shaped design, the connecting element of each of said springs being anchored in a common plane alongside one another in the base body with contact-making regions overlapping one another, so that the armature can operate the moving contact spring via a slide which can move at right angles to a longitudinal extent of said moving contact spring, the improvements comprising said stationary contact spring resting on a stop on the base body and having the contact-making region being prestressed by elastic deflection from the common plane by said stop and said common plane extending parallel to the central axis.

2. A relay according to claim 1 , wherein said base body is a coil former having first and second coil flanges, the contact springs are anchored in the first coil flange, and the stop which produces the prestressing for the stationary contact spring is integrally formed on the second coil flange.

3. A relay according to claim 1, wherein the stationary contact spring and the moving contact spring are of identical shape and are inserted into the base body in a plane with mirror-image symmetry with respect to one another.

4. A relay according to claim 1, wherein the stationary contact spring has an integrally formed restoring spring arm, which is decoupled from the stationary contact spring, and acts on the slide to prestress the armature into a rest position.

5. A relay according to claim 4, which has a moving contact spring, a stationary make contact spring and a stationary break contact spring anchored in the base body, and the restoring spring arm is integrally formed on the break contact spring and acts on an attachment on the slide next to the moving contact spring.

6. A relay comprising:

a base body;

an electromagnetic system which is connected to the base body, said electromagnetic system having a coil with a central axis, a core on said axis and an armature; and a contact arrangement having a stationary contact spring and a moving contact spring, each contact spring being a planar leaf spring with a connecting element and a contact-making region, the contact-making region of at least one contact spring having an L-shaped design, the connecting element of each spring being anchored in a common plane alongside one another in the base body with contact-making regions overlapping one another, so that the armature can operate the moving contact spring via a slide which can move at right angles to the longitudinal extent of said moving contact spring, the improvements comprising said stationary contact spring resting on a stop on the base body and having the contact-making region being prestressed by elastic deflection from the common plane by said stop, said base body being a coil former having first and second coil flanges, the contact springs being anchored parallel to the coil axis in the first coil flange, and the stop which produces the prestressing for the stationary contact spring being integrally formed on the second coil flange, the core being a T-shaped core having a longitudinal limb with transverse limbs extending therefrom, said longitudinal limb extending axially through the coil former, the armature being a U-shaped armature with longitudinal arms extending from a transverse portion arranged on a side of the coil former which faces away from the contact springs and being mounted by a transverse portion in a region of the first coil flange on a free end of the longitudinal limb of the core, and the longitudinal arms of the U-shaped armature having free ends to operate the slide.

7. A relay according to claim 6, wherein the slide is guided between the second coil flange and the transverse limbs of the core.

8. A relay according to claim 6, wherein the moving contact spring exerts a restoring force on the armature, via the slide.

9. A relay comprising:

a base body having a pair of planar slots arranged in a common plane;

an electromagnetic system which is connected to the base body, said electromagnetic system having a coil with a central axis, a core on said central axis and an armature; and a contact arrangement having a stationary contact spring and a moving contact spring, each contact spring being a planar leaf spring with a connecting element and a contact-making region, the contact-making region of at least one contact spring having an L-shaped design, the connecting elements of the springs being anchored in the pair of slots of the base body with contact-making regions overlapping one another, so that the armature can operate the moving contact spring via a slide which can move at right angles to a longitudinal extent of said moving contact spring, said stationary contact spring resting on a stop on the base body and having the contact-making region being prestressed by elastic deflection from the common plane by said stop and said common plane extending parallel to the central axis.

10. A relay according to claim 9, wherein said base body is a coil former having first and second coil flanges, the contact springs are anchored in the first coil flange, and the stop which produces the prestressing for the stationary contact spring is integrally formed on the second coil flange.

11. A relay according to claim 9, wherein the stationary contact spring and the moving contact spring are of identical shape and are inserted into the slots of the base body in a plane with mirror-image symmetry with respect to one another.

12. A relay according to claim 9, wherein the stationary contact spring has an integrally formed restoring spring arm, which is decoupled from the stationary contact spring, and acts on the slide to prestress the armature into a rest position.

13. A relay according to claim 12, which has a moving contact spring, a stationary make contact spring and a stationary break contact spring anchored in the base body, and the restoring spring arm is integrally formed on the break contact spring and acts on an attachment on the slide next to the moving contact spring.

14. A relay according to claim 9, wherein the base body is a coil former having first and second coil flanges, said pair of slots being in the first coil flange, the stop is integrally formed on the second coil flange, the core is a T-shaped core having a longitudinal limb with transverse limbs extending therefrom, said longitudinal limb extends axially through the coil former, the armature is a U-shaped armature with longitudinal arms extending from a transverse portion arranged on a side of the coil former which faces away from the contact springs and is mounted by a transverse portion in a region of the first coil flange on a free end of the longitudinal limb of the core, and the longitudinal arms of the U-shaped armature have free ends to operate the slide.

15. A relay according to claim 14, wherein the slide is guided between the second coil flange and the transverse limbs of the core.

16. A relay according to claim 14, wherein the moving contact spring exerts a restoring force on the armature, via the slide.

* * * * *